United States Patent [19]

Young et al.

[11] Patent Number: 5,002,461

[45] Date of Patent: Mar. 26, 1991

[54] COMPRESSOR IMPELLER WITH DISPLACED SPLITTER BLADES

[75] Inventors: Michael Y. Young; Andrew G. Struble, both of Indianapolis, Ind.

[73] Assignee: Schwitzer U.S. Inc., Indianapolis, Ind.

[21] Appl. No.: 470,811

[22] Filed: Jan. 26, 1990

[51] Int. Cl.[5] ..... F04D 17/10

[52] U.S. Cl. ..... 416/183; 416/185

[58] Field of Search ..... 416/179, 180, 183, 184, 416/185, 203

[56] References Cited

U.S. PATENT DOCUMENTS

| | | | |
|---|---|---|---|
| 912,362 | 2/1909 | Capell | 416/184 |
| 2,648,493 | 8/1953 | Stalker | 416/185 X |
| 2,753,808 | 7/1956 | Kluge | 416/183 |
| 3,069,072 | 12/1962 | Birmann | 416/183 X |
| 3,904,308 | 9/1975 | Riband | 416/183 X |
| 4,520,541 | 6/1985 | Miki et al. | 416/183 X |

FOREIGN PATENT DOCUMENTS

| | | | |
|---|---|---|---|
| 205001 | 12/1986 | European Pat. Off. | 416/183 |

*Primary Examiner*—Edward K. Look
*Assistant Examiner*—James A. Larson
*Attorney, Agent, or Firm*—Woodard, Emhardt, Naughton, Moriarty & McNett

[57] ABSTRACT

An impeller for a centrifugal compressor includes a hub, several main blades mounted to the hub, and several splitter blades mounted to the hub, each splitter blade being located between adjacent main blades and being disposed from a position centered between the adjacent main blades by an amount of about 6% to about 33% of one half the angular distance between the main blades.

32 Claims, 3 Drawing Sheets

| RPM/1000 | | RPM/1000 | |
|---|---|---|---|
| ⊙··○ | = 50 | ⊙—⊙ | = 50 |
| △··△ | = 60 | △—△ | = 60 |
| ◊··◊ | = 69 | ◊—◊ | = 69 |
| ☆··☆ | = 79 | ☆—☆ | = 79 |
| ◈··◈ | = 89 | ◈—◈ | = 89 |
| ◄··◄ | = 99 | ◄—◄ | = 99 |

COMPRESSOR IMPELLER WITH DISPLACED SPLITTER BLADES

BACKGROUND OF THE INVENTION

1. Field of the Invention

The present invention relates to the field of impellers for centrifugal compressors, and particularly to an impeller having novel placement of splitter blades.

2. Description of the Prior Art:

Centrifugal compressors have a wide ranging variety of applications, including typical use in superchargers or gas turbines. It is desirable to obtain a maximum efficiency for such compressors, particularly in relationship to particular ranges of operation. It is also important to obtain superior operating characteristics while retaining a compact design.

There are several design constraints in trying to optimize the operating characteristics of a centrifugal compressor. Various approaches have been pursued in the prior art to improve on compressor design, many of these relating to the blading of the impeller. However, the success of different blading approaches is difficult to predict, due to the unique nature of compressible fluids, as opposed to non-compressible fluids. For example, experience with centrifugal pumps used with incompressible liquids is not directly transferable to the design of compressors. For this and other reasons, many different types of designs have been proposed in the prior art, not all with great success.

In U.S. Pat. No. 4,167,369, issued to Ishihara on Sept. 11, 1979, there is described an impeller having specially contoured blades for use in a centrifugal compressor. The blades of the Ishihara design have an impeller portion extending radially of the impeller disk to its outer perimeter, and a centrally located inducer portion angled from the impeller portion in the direction of impeller rotation. The angle between the impeller portion and the front face of the disk is about 90 degrees at the inner end and gradually increases toward the outer end to about 50 to 70 degrees. Intermediate splitter blades are spaced equally between adjacent full blades. A dual entry centrifugal compressor is disclosed in U.S. Pat. No. 4,530,639 issued to Mowell on July 23, 1985, and includes splitter blades which are equally spaced between adjacent full blades.

In U.S. Pat. No. 4,060,337 issued to Bell, III on Nov. 29, 1977, there is described a centrifugal compressor having a splitter shroud in the flow path. The impeller of the Bell, III Patent includes blades which are all of identical height and contour. A centrifugal fan having associated pairs of blades of similar design is described in U.S. Pat. No. 2,083,996 issued to Jonn on June 15, 1937.

An offset centrifugal compressor is described in U.S. Pat. No. 4,615,659 issued to Sydransky on Oct. 7, 1986. The impeller of the Sydransky device includes blades which are comprised of three separate segments extending generally end-to-end. Gaps are provided between the adjacent ends of the blade parts to permit gas to travel therethrough from the Pressure side to the suction side, which is intended to control boundary layer build-up and reduce separation of gas from the blades.

SUMMARY OF THE INVENTION

Briefly describing one aspect of the present invention, there is provided an impeller for a centrifugal compressor which includes a hub, several main blades mounted to the hub and spaced equi-radially about the hub, and several splitter blades mounted to the hub, each splitter blade being positioned between a pair of adjacent main blades and being displaced in either direction from a position centered between the adjacent main blades. The splitter blades are displaced by an amount from about 6% to about 33% of one half the angular distance between the adjacent main blades.

It is an object of the present invention to provide an impeller for a centrifugal compressor which is relatively simple in design and readily fabricated.

A further object of the present invention is to provide an impeller for a centrifugal compressor which has improved operating characteristics.

It is another object of the present invention to provide an impeller which is useful with various types of centrifugal compressors, including axial flow, radial flow, and mixed axial/radial flow.

Further objects and advantages of the present invention will become apparent from the description of the preferred embodiment which follows.

DESCRIPTION OF THE PREFERRED EMBODIMENT

Figure 2:
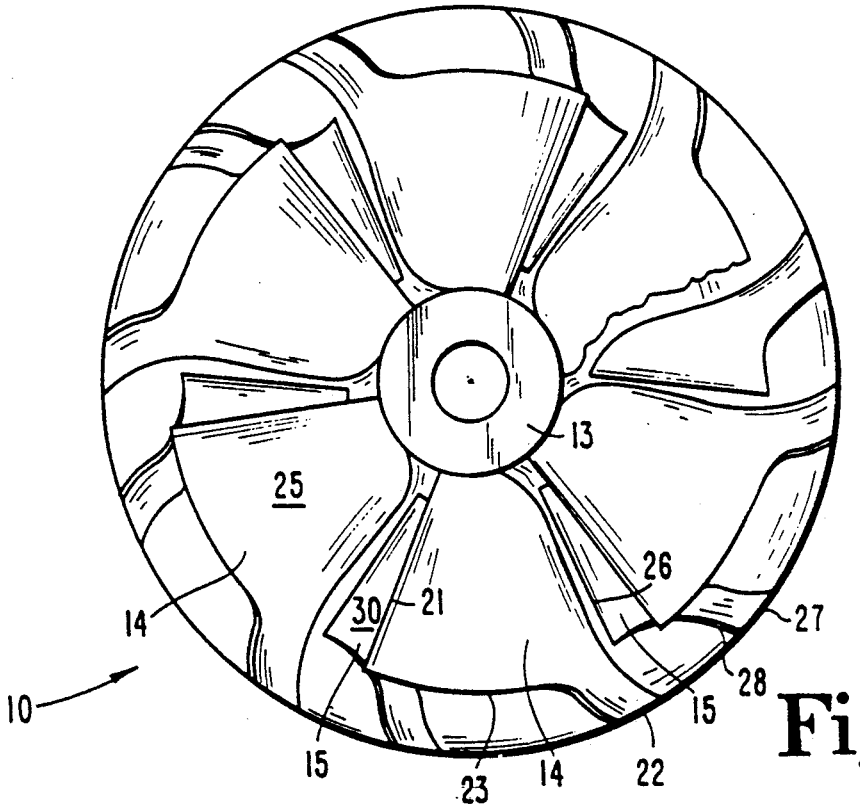
FIG. 2 is a top, plan view of the impeller of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides an impeller for a centrifugal compressor having improved operating characteristics. The impeller remains simple and compact in design, and is readily fabricated. This is in contrast to certain prior art designs using elaborate and sometimes multi-segmented blade designs, or other modifications. The impeller with displaced splitter blades, as described herein, may be fabricated in the same manner as is presently conventional, and may utilize any of a variety of blade configurations, including those which are shown in the prior art. The impeller of the present invention is useful with a variety of centrifugal compressors. In broad terms, these include axial flow, radial flow and mixed flow compressors.

Referring in particular to the drawings, there is shown an impeller 10 constructed in accordance with a preferred embodiment of the present invention. Impeller 10 includes a hub 11 of a generally conical shape. The hub tapers inwardly from a disc-shaped portion 12 to an annular portion 13. Several main blades 14 and splitter blades 15 are mounted to the hub.

The impeller 10 includes means for mounting the impeller for rotation about a central axis 16. The impeller is mounted within a housing 17 defining an appropriate inlet and outlet. In a preferred embodiment, the centrifugal compressor includes an axial flow inlet 18 and a radial flow outlet 19. The housing 17 in conventional fashion includes a shroud wall 20 which closely conforms to the main blades 14.

Figure 1:
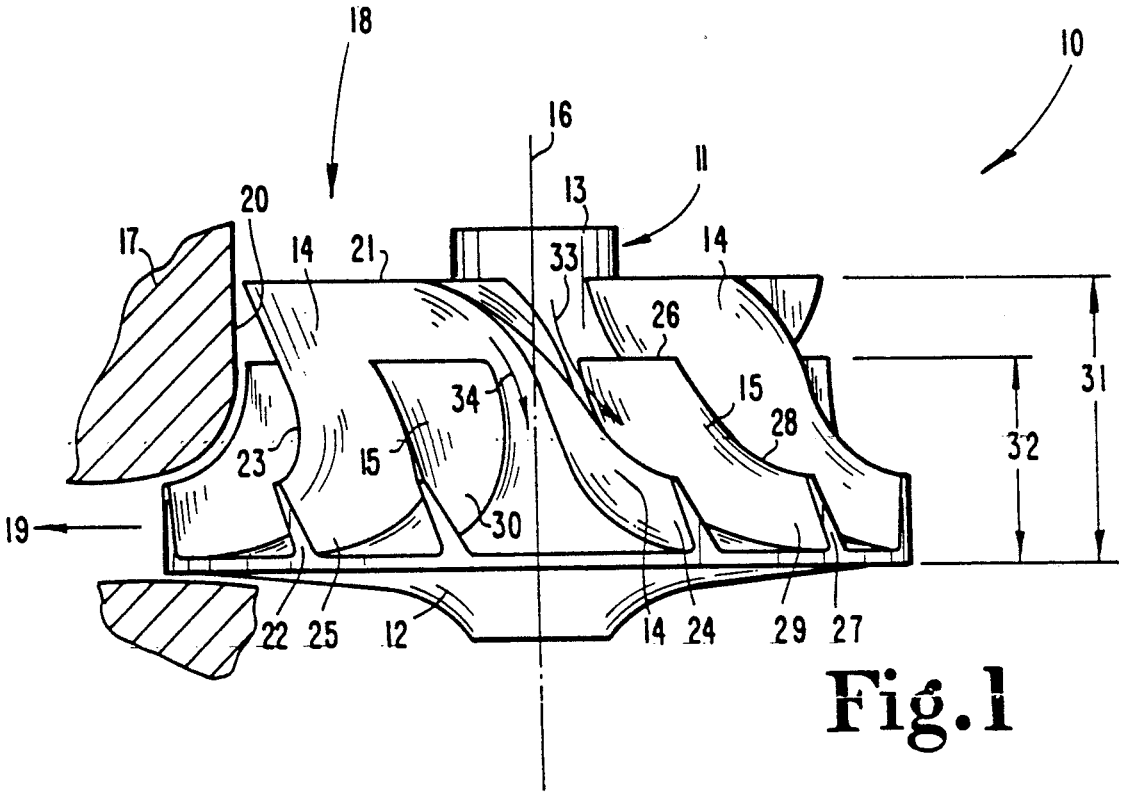
FIG. 1 is a side, elevational view of an impeller for a centrifugal compressor constructed in accordance with the preferred embodiment of the present invention.

The main blades 14 are mounted to the hub and spaced equiangularly about the central axis 16, as shown particularly in FIG. 2. The impeller may include various numbers of main blades, with a preferred embodiment including six main blades spaced 60° apart from one another. The present invention is not limited to any particular design for the main blades, which therefore may have any of a number of different configurations. A typical curved main blade is shown in the embodiment of FIG. 1. Each blade extends from a leading edge 21 to a trailing edge 22, and includes a side edge 23 with which the shroud wall 20 closely conforms. As a result of the rotation of impeller 10 about axis 16, each main blade defines a pressure surface 24 on one side of the blade and a suction surface 25 on the other side.

Several splitter blades 15 are also mounted to the hub 11. Each splitter blade includes a leading edge 26, trailing edge 27 and a side edge 28. In addition, each splitter blade includes a pressure surface 29 and a suction surface 30. The splitter blades may also have a variety of configurations, and the present invention is not limited to a particular design for the shape of the splitter blades. However, a preferred embodiment of the present invention includes splitter blades which are substantially identical to the shapes of the main blades. More particularly, the main blades extend axially from the disc-shaped end 12 a first distance 31, and the splitter blades extend from the disc-shaped end 12 a smaller, second distance 32. In the preferred embodiment, the main blades 14 are configured identically with the splitter blades 15 for the full axial extent of the splitter blades, equal to the distance 32. This identity of configuration is useful in facilitating the fabrication of the impeller, as is understood in the art. Therefore, although the present invention is not limited to any particular design for the blades, it is preferable that the main blades and splitter blades be configured the same for fabrication purposes.

Each of the splitter blades 15 is received between a pair of adjacent main blades 14. As shown for example in FIG. 1, each splitter blade is therefore received between the pressure surface 24 of one adjacent main blade, and the suction surface 25 of other adjacent main blade. As for the main blades, the splitter blades are preferably spaced equiangularly about the central axis of the hub 11. However, in contrast to the prior art, the splitter blades of the present invention are displaced from a position centered between the adjacent main blades. Thus, the splitter blades are located closer to one of the adjacent main blades than the other of the adjacent main blades.

In accordance with the present invention, the splitter blades are displaced in either direction from a position centered between the adjacent main blades, and a resulting improvement in the operating characteristics of the impeller is achieved. It will be appreciated that the impeller 10, and particularly the blades 14 and 15, define a number of flow channels, such as 33 and 34, for compressible fluid being acted upon by the compressor. The displacement of the splitter blades in this fashion results in a change in the mass flow of compressible fluid through the channels defined by the impeller. Varying the degree and direction of displacement of the splitter blades 15 will provide resulting variations in the operating characteristics of the impeller, which then may be matched to desired performance requirements. The splitter blades are displaced to either side of the bisector of the adjacent main blades to achieve desired operating characteristics.

The impeller flow channels are of two types. A first flow channel 33 is defined as the space between the suction surface 25 of one of the main blades, and the facing, pressure surface 29 of the adjacent splitter blade. The second flow channel 34 is defined by the space between the suction surface 30 of a splitter blade and the facing, pressure surface 24 of an adjacent main blade. It has been determined that the mass flow through these two different types of channels 33 and 34 is controllable by displacement of the splitter blades between the adjacent main blades.

It has further been determined that the placement of the splitter blade in a position centered between the adjacent main blades does not result in equal mass flow through the two channels 33 and 34. Therefore, in one aspect of the present invention, the splitter blades are displaced in the direction and to the extent necessary to substantially equalize the mass flow through the two channels 33 and 34. The displacement of the splitter blades may be on either side of the bisector of the adjacent main blades. The desired displacement of the splitter blades will depend on various factors, such as the shape of the blades, the angle of incidence of the blades, the size of the blades and of the impeller, the operating speed range, etc. However, the displacement necessary to equalize the mass flow through the channels 33 and 34 may be determined for a given design of impeller and blades by measurement of the mass flow, such as by use of a velocimeter.

In accordance with the present invention, the splitter blades are displaced in either direction from a position centered between adjacent main blades by at least about 6% of one half the angular distance between the adjacent main blades. The splitter blades are preferably displaced by at most about 33% of one half the angular distance between the adjacent main blades, and in the preferred embodiment are displaced by about 20%.

The impeller may include different numbers of main blades and splitter blades. In a preferred embodiment, the impeller includes six main blades spaced 60° apart from one another. The splitter blades are then displaced in either direction at least about 2° and at most about 10°, and most preferably about 6°, from a position centered between the adjacent main blades.

Further, in a preferred embodiment of the present invention, the splitter blades are displaced in the direction of rotation of the impeller. In other words, the splitter blades are displaced in a direction toward the facing suction side of one of the adjacent main blades and away from the facing, pressure side of the other adjacent main blade.

The maldistribution of mass flow for the two different types Of channels in an impeller with splitter blades has been confirmed by laser measurement. Tests performed on a 91 mm. turbocharger compressor, using a Laser-Two Focus (L2F) Velocimeter were conducted to determine the flow fields in the two adjacent flow passages of an impeller. A plot of meridional velocity measured across two adjacent flow passages indicated that the quantity of air flow in one channel may be as much as 40% higher than the flow through the adjacent flow channel. A suspected flow maldistribution between two adjacent flow passages was confirmed by the laser tests. Tests further indicated that the flow maldistribution is a function of the incidence angle at the impeller inlet (inducer).

Figure 3:
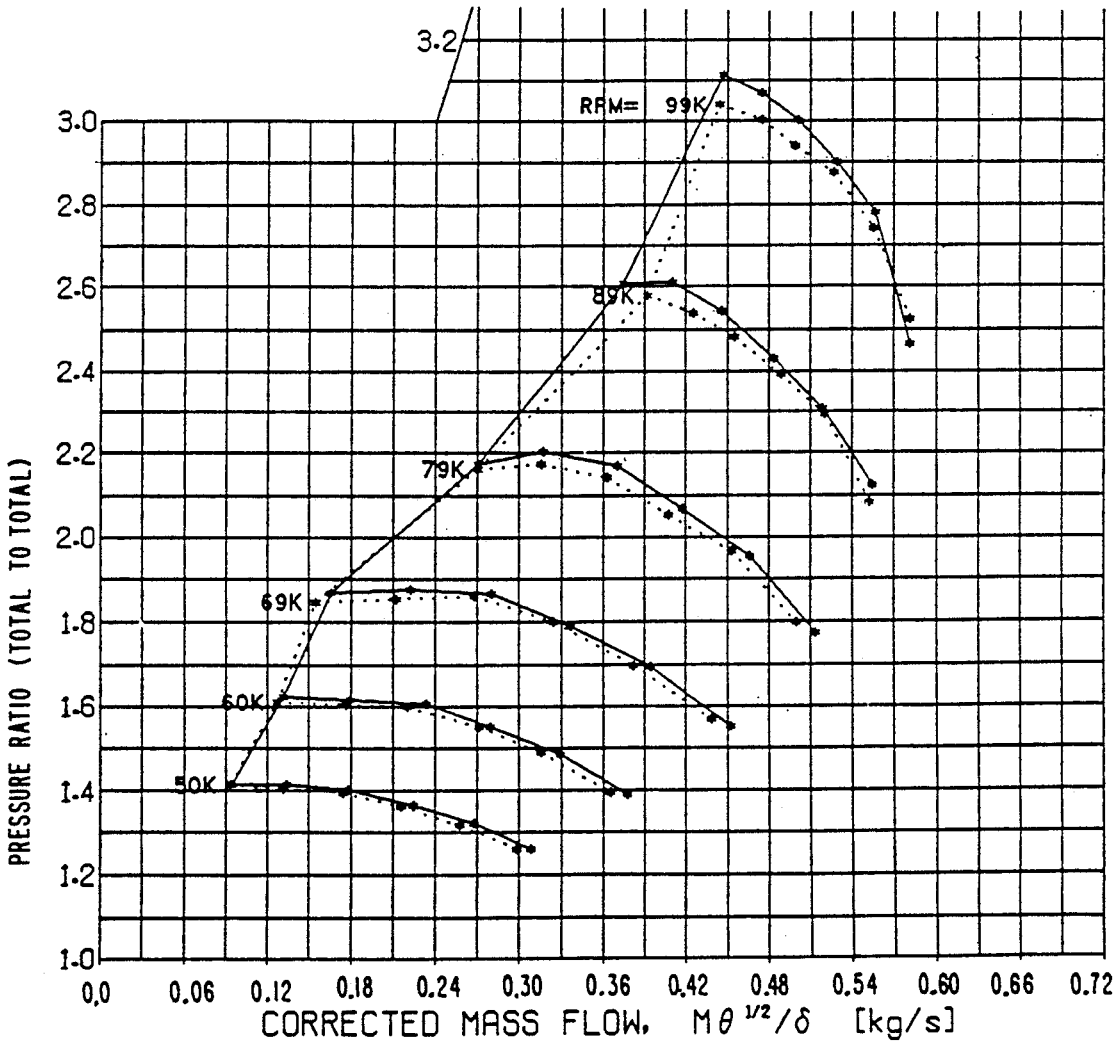
FIG. 3 is a graph demonstrating the improved operating characteristics of the impeller with displaced splitter blades of the present invention.
Figure 4:
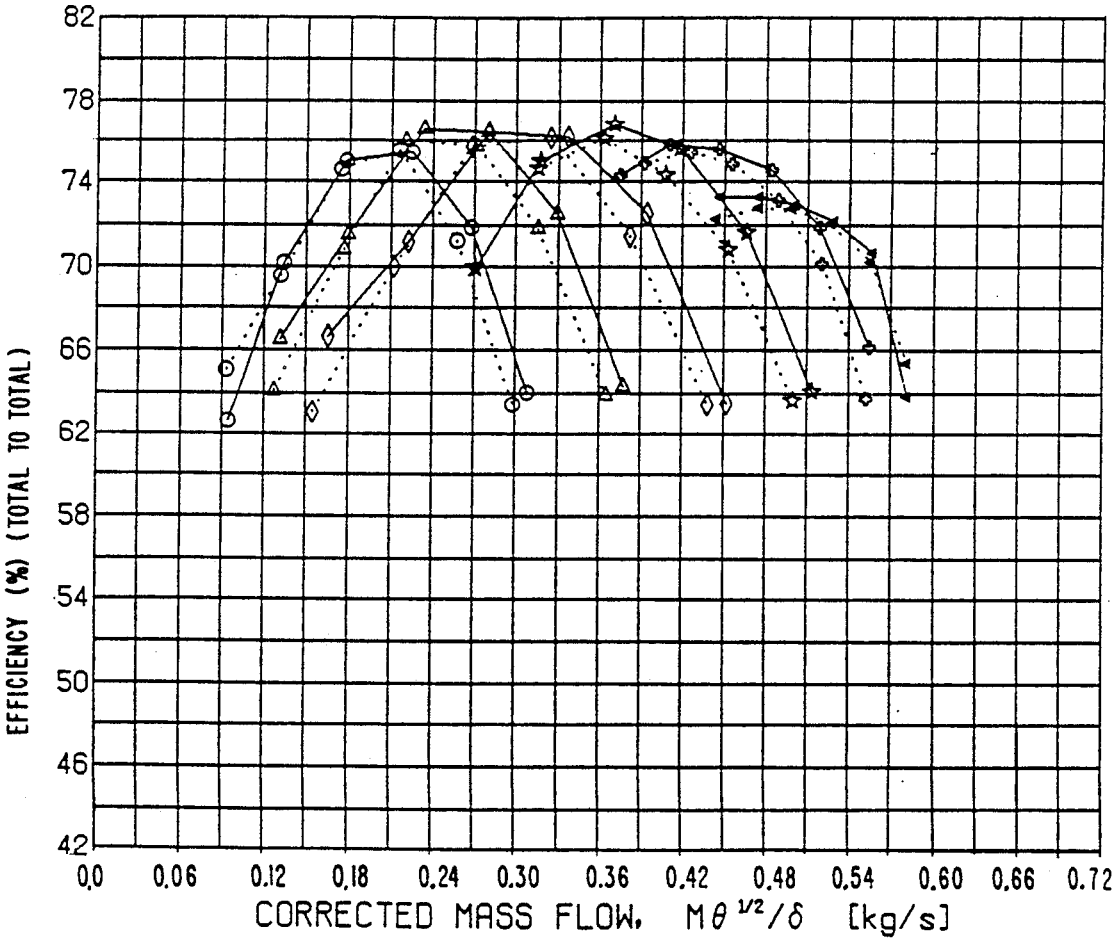
FIG. 4 is a graph demonstrating the improved efficiency achieved with the present invention.

A comparison was made between a centrifugal compressor impeller fabricated with a splitter offset of 6° in the direction of rotation, and a conventional impeller having the splitter blades centered between the adjacent main blades. The results of the comparison of the two different compressor impellers is shown in FIGS. 3 and 4. Each impeller had a wheel diameter of 3.6 inches, with the inlet or inducer diameter for the blades being 2.674 inches. In both figures, the results for the conventional prior art impeller with centered splitter blades is shown in dotted lines, and the results for the impeller with displaced splitter blades according to the present invention are shown in solid lines.

It was determined that the present invention yielded improved operating characteristics for surge, boost pressure and efficiency. In FIG. 3, movement of the line to the left for the impeller with displaced splitter blade shows that surge will not occur until a lower flow rate, and movement of the line higher on the graph shows an increased boost pressure. There is shown in FIG. 3, a clear boost pressure increase and surge margin improvement, particularly at the high speeds. In FIG. 4, there is also shown an efficiency improvement of up to two percentage points for the impeller having the offset splitter blades. Movement of the line to a higher position in FIG. 5 indicates a higher efficiency, correlating to a higher pressure for a given mass flow rate.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An impeller for a centrifugal compressor which comprises:

a hub including means for mounting said hub for rotation about a central axis;

several main blades mounted to said hub and spaced equiangularly about the central axis of said hub; and, several splitter blades mounted to said hub and positioned between adjacent ones of said main blades, the number of splitter blades equalling the number of main blades, a single splitter blade being received between two adjacent main blades, each said splitter blade being displaced from a position centered between the adjacent ones of said main blades by at least about six percent of one half the annular distance between the adjacent main blades.

2. The impeller of claim 1 in which said splitter blades are spaced equiangularly about the central axis of said hub.

3. The impeller of claim 1 in which said hub tapers inwardly from a disc shaped portion at one axial end to an annular portion at the other axial end, said main blades extending axially from the disc shaped portion and first distance and said splitter blades extending axially from the disc shaped portion a second distance less than the first distance.

4. The impeller of claim 3 in which said main blades and said splitter blades are configured identically for the extent of the second distance.

5. The impeller of claim 1 in which each said splitter blade is displaced from a position centered between the adjacent ones of said main blades by at most about thirty three percent of one half the angular distance between the adjacent main blades.

6. The impeller of claim 5 in which said splitter blades are spaced equiangularly about the central axis of said hub.

7. The impeller of claim 6 in which said hub tapers inwardly from a disc shaped portion at one axial end to an annular portion at the other axial end, said main blades extending axially from the disc shaped portion and first distance and said splitter blades extending axially from the disc shaped portion a second distance less than the first distance.

8. The impeller of claim 7 in which said main blades and said splitter blades are configured identically for the extent of the second distance.

9. The impeller of claim 1 in which each said splitter blade is displaced from a position centered between the adjacent ones of said main blades by about twenty percent of one half the angular distance between the adjacent main blades.

10. The impeller of claim 9 in which said splitter blades are spaced equiangularly about the central axis of said hub.

11. The impeller of claim 1 and which includes six main blades spaced sixty degrees apart and which further includes six splitter blades located between adjacent ones of said six main blades, each of said splitter blades being displaced from a position centered between adjacent main blades by at least about two degrees.

12. The impeller of claim 11 in which said splitter blades are spaced equiangularly about the central axis of said hub.

13. The impeller of claim 11 in which each of said splitter blades is displaced from a position centered between adjacent main blades by at most about ten degrees.

14. The impeller of claim 13 in which said splitter blades are spaced equiangularly about the central axis of said hub.

15. The impeller of claim 11 in which each of said splitter blades is displaced from a position centered between adjacent main blades by about six degrees.

16. The impeller of claim 15 in which said splitter blades are spaced equiangularly about the central axis of said hub.

17. The impeller of claim 1 in which each of said main blades includes a pressure surface and a suction surface, each said splitter blade being located between the pressure surface of one adjacent main blade and the suction surface of the other adjacent main blade, said splitter blades being displaced from a centered position in the direction away from the adjacent pressure surface.

18. The impeller of claim 17 in which said splitter blades are spaced equiangularly about the central axis of said hub.

19. The impeller of claim 17 in which said hub tapers inwardly from a disc shaped portion at one axial end to an annular portion at the other axial end, said main blades extending axially from the disc shaped portion and first distance and said splitter blades extending axially from the disc shaped portion a second distance less than the first distance.

20. The impeller of claim 19 in which said main blades and said splitter blades are configured identically for the extent of the second distance.

21. The impeller of claim 17 in which each said splitter blade is displaced from a position centered between the adjacent ones of said main blades by at most about thirty three percent of one half the angular distance between the adjacent main blades.

22. The impeller of claim 21 in which said splitter blades are spaced equiangularly about the central axis of said hub.

23. The impeller of claim 22 in which said hub tapers inwardly from a disc shaped portion at one axial end to an annular portion at the other axial end, said main blades extending axially from the disc shaped portion and first distance and said splitter blades extending axially from the disc shaped portion a second distance less than the first distance.

24. The impeller of claim 23 in which said main blades and said splitter blades are configured identically for the extent of the second distance.

25. The impeller of claim 17 in which each said splitter blades is displaced from a position centered between the adjacent ones of said main blades by about twenty percent of one half the angular distance between the adjacent main blades.

26. The impeller of claim 25 in which said splitter blades are spaced equiangularly about the central axis of said hub.

27. The impeller of claim 17 and which includes six main blades spaced sixty degrees apart and which further includes six splitter blades located between adjacent ones of said six main blades, each of said splitter blades being displaced from a position centered between adjacent main blades by at least about two degrees.

28. The impeller of claim 27 in which said splitter blades are spaced equiangularly about the central axis of said hub.

29. The impeller of claim 27 in which each of said splitter blades is displaced from a position centered between adjacent main blades by at most about ten degrees.

30. The impeller of claim 29 in which said splitter blades are spaced equiangularly about the central axis of said hub.

31. The impeller of claim 27 in which each of said splitter blades is displaced from a position centered between adjacent main blades by about six degrees.

32. The impeller of claim 31 in which said splitter blades are spaced equiangularly about the central axis of said hub.

* * * * *